US011527202B2

(12) United States Patent
Kim et al.

(10) Patent No.: US 11,527,202 B2
(45) Date of Patent: Dec. 13, 2022

(54) DISPLAY DEVICE

(71) Applicant: Samsung Display Co., Ltd., Yongin-si (KR)

(72) Inventors: Kyun Ho Kim, Hwaseong-si (KR); Jong-Keun Kim, Hwaseong-si (KR); Min Young Park, Busan (KR); Jong Min Shim, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 132 days.

(21) Appl. No.: 16/542,165

(22) Filed: Aug. 15, 2019

(65) Prior Publication Data

US 2020/0143745 A1 May 7, 2020

(30) Foreign Application Priority Data

Nov. 5, 2018 (KR) ..... 10-2018-0134592

(51) Int. Cl.
*G09G 3/32* (2016.01)
*G09G 3/3258* (2016.01)

(52) U.S. Cl.
CPC ... *G09G 3/3258* (2013.01); *G09G 2320/0673* (2013.01); *G09G 2330/021* (2013.01)

(58) Field of Classification Search
CPC ..... G09G 3/3258; G09G 2320/0673; G09G 2330/021
See application file for complete search history.

(56) References Cited

U.S. PATENT DOCUMENTS

2014/0085290 A1* 3/2014 Yu ..... G09G 3/3208 345/212
2014/0104259 A1* 4/2014 Oh ..... G09G 3/3275 345/212
2017/0256194 A1* 9/2017 Kim ..... G09G 3/2092
2017/0322608 A1* 11/2017 Lee ..... G09G 3/006
2020/0143762 A1* 5/2020 Huang ..... G09G 3/3648

FOREIGN PATENT DOCUMENTS

KR 10-0753034 B1 8/2007
KR 10-2015-0078157 A 7/2015
KR 10-1657702 B1 9/2016
KR 10-2017-0126566 A 11/2017
KR 10-2018-0005866 A 1/2018
WO WO 2010/097753 A1 9/2010

* cited by examiner

*Primary Examiner* — Towfiq Elahi
(74) *Attorney, Agent, or Firm* — Lewis Roca Rothgerber Christie LLP

(57) ABSTRACT

A display device according to an exemplary embodiment includes: a display panel including a plurality of pixels; a plurality of source boards connected to the display panel; a power control board connected to the source board and configured to supply a power voltage to the plurality of pixels; and a control board configured to control an output of voltages supplied to the source board according to a control signal transmitted by the power control board.

17 Claims, 6 Drawing Sheets

DISPLAY DEVICE

CROSS-REFERENCE TO RELATED APPLICATION

This application claims priority to and the benefit of Korean Patent Application No. 10-2018-0134592 filed in the Korean Intellectual Property Office (KIPO) on Nov. 5, 2018, the entire contents of which are incorporated herein by reference.

BACKGROUND

1. Field

The present disclosure relates to a display device.

2. Description of the Related Art

In general, display devices include a display panel having a plurality of pixels, and a power voltage transmitted through a power cable from a power control board is applied to the pixels. As the resolution of display devices increases and the display device becomes larger, a load of the display increases and a current flowing through the power cable increases. To reduce the load, a power voltage may be supplied to pixels of the display panel through a plurality of power cables. When some of the power cables for supplying a power voltage are not normally connected (e.g., abnormally connected, not fastened, or erroneously fastened), luminance may be reduced or abnormal heat may be generated on a portion of the display panel that is near the not fastened/erroneously fastened power cable.

To supply a data signal to the pixels, a data driver includes a gamma voltage generator and a driving circuit. A driving voltage transmitted from a control board through a power cable is applied to the driving circuit and the gamma voltage generator. When a gamma voltage generated by the gamma voltage generator is transmitted to the driving circuit before the driving voltage is normally applied to the driving circuit, the driving circuit may not operate normally.

The above information disclosed in this Background section is only for enhancement of understanding of the background and therefore it may contain information that does not form the prior art that is already known in this country to a person of ordinary skill in the art.

SUMMARY

Exemplary embodiments of the present invention has been made in an effort to provide a display device for sensing a connection state of power cables and controlling a power voltage. Exemplary embodiments of the present invention provide a display device for controlling a driving voltage so as to normally apply a driving voltage to a driving circuit.

An exemplary embodiment of the present invention provides a display device that includes: a display panel having a plurality of pixels; a plurality of source boards connected to the display panel; a power control board connected to the plurality of source boards and configured to supply a power voltage to the plurality of pixels; and a control board configured to control an output of voltages supplied to the source board according to a control signal transmitted by the power control board.

The power control board may be connected to the plurality of source boards through a plurality of first cables.

The power control board may output the control signal to prevent the output of voltages to at least one source board when at least one of the plurality of first cables is abnormally connected to the at least one source board.

The power control board is configured to output the control signal by using values of the power voltages applied to the plurality of source boards.

The power control board may include a plurality of first connectors, the plurality of source boards may respectively include a second connector, and first ends of the plurality of first cables may be connected to the first connectors, while second ends thereof may be connected to the second connector included in the respective source boards.

The plurality of first cables may respectively include a power voltage wire, the power control board may include a sensing resistor of which a first end connected to the power voltage wire when the first cable is normally fastened to the second connector, and the first end may not be connected to the power voltage wire when the first cable is abnormally fastened to the second connector, and a comparing resistor connected to a second end of the sensing resistor, and the control signal may correspond to a voltage value divided by the sensing resistor and the comparing resistor.

The voltage value divided by the sensing resistor and the comparing resistor may be higher when the plurality of first cables are normally fastened to a second connector than when the plurality of first cables are abnormally fastened to the second connector.

The first cables may respectively include a power voltage wire, the source boards may respectively include a sensing resistor of which a first end is connected to the power voltage wire when the first cable is normally fastened to the second connector, and the first end is not connected to the power voltage wire when the first cable is abnormally fastened to the second connector, the power control board may include a comparing resistor connected to the second end of the sensing resistor when the first cable is normally fastened to the second connector, and not connected to the second end of the sensing resistor when the first cable is abnormally fastened to the second connector, and the control signal may correspond to the voltage value divided by the sensing resistor and the comparing resistor.

The control board may be connected to the source boards through a plurality of second cables.

The control board may include: a voltage generator for generating a driving voltage of a driving circuit for generating a data signal applied to at least one of the pixels; a gamma voltage generator for receiving the driving voltage and generating a plurality of gamma voltages applied to the driving circuit; and a switch for transmitting the driving voltage to the gamma voltage generator corresponding to the control signal.

The driving voltage and the plurality of gamma voltages may be transmitted to the plurality of source boards through the plurality of second cables.

The switch may transmit the driving voltage to the gamma voltage generator according to intensity of the driving voltage and the control signal transmitted to the second cables.

The driving circuit may be mounted on a driving circuit package for connecting the display panel and the source board.

The power voltage may be transmitted to the pixels through a wire of the driving circuit package.

The control board and the power control board may be connected through a third cable, and when the control signal transmitted to the control board through the third cable exceeds a predetermined level, voltages supplied to the source board may be output.

Another embodiment of the present invention provides a display device including: a display panel including a plurality of pixels; a power control board configured to transmit a power voltage to the pixels through a plurality of cables, and to output a voltage corresponding to a voltage value transmitted through the cable as a control signal; and a control board configured to generate a plurality of gamma voltages applied to the driving circuit when the driving voltage for operating a driving circuit configured to generate a data signal transmitted to the pixels and a voltage corresponding to a sum of the driving voltage and the control signal exceeds a predetermined level.

A voltage value of the control signal may change according to a fastening state of the cables.

The power control board may include an AND gate circuit for generating a control signal by performing an AND operation on the voltage corresponding to the voltage value transmitted through the cable.

The control board may include: a gamma generator to generate the gamma voltages; a switch to transmit the driving voltage to the gamma voltage generator; and an AND gate circuit to output a signal for controlling the switch by performing an AND operation on the driving voltage and a voltage of the control signal.

Another embodiment of the present invention provides a display device including: a display panel including a plurality of pixels; a plurality of source boards connected to the display panel; a plurality of driving circuit packages each including a driving circuit for connecting the display panel and a corresponding source board and generating a data signal applied to the pixels, and transmitting a power voltage to the pixels; a power control board connected to the plurality of source boards through a plurality of first cables and transmitting the power voltage; and a control board connected to the source boards through the first cables, generating a driving voltage for operating the driving circuit and a plurality of gamma voltages, transmitting the same, and controlling the gamma voltages corresponding to levels of the power voltage and the driving voltage.

According to the exemplary embodiments, the display device may be prevented from being burnt by an overcurrent that may be generated when the power cables are abnormally fastened.

According to the exemplary embodiments, the driving circuit of the data driver may be normally operated.

According to the exemplary embodiments, the circuit mounted on the display device may be protected at a low cost.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

DETAILED DESCRIPTION

Figure 1:
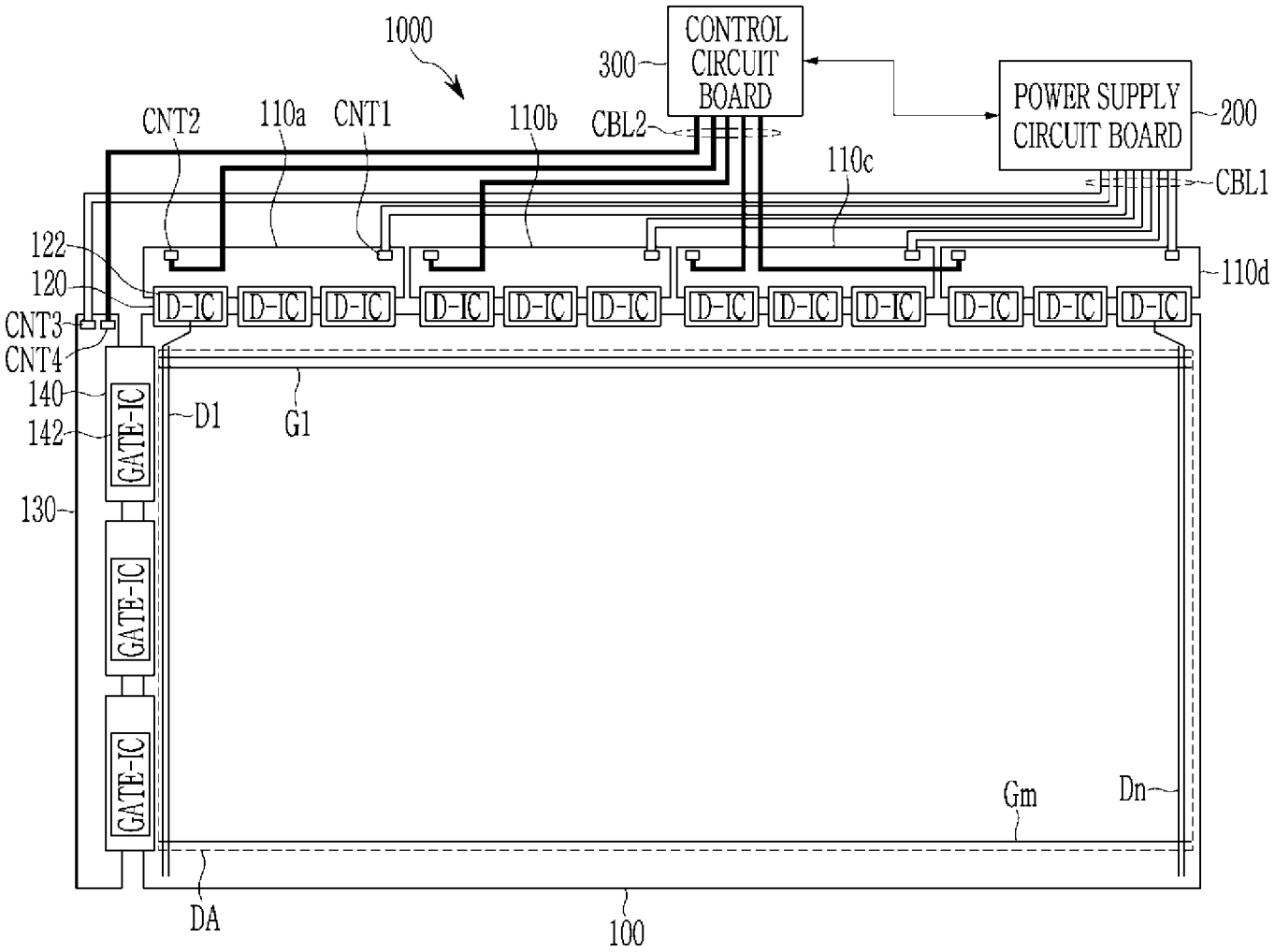
FIG. 1 shows a block diagram of a display device according to an exemplary embodiment.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The display device or display devices and/or any other relevant devices or components, such a display panel including a plurality of pixels PX, source boards, a gate board, a power control board, and a control board, according to embodiments of the present invention described herein may be implemented utilizing any suitable hardware, firmware (e.g., an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 shows a block diagram of a display device according to an exemplary embodiment.

Referring to FIG. 1, the display device 1000 includes a display panel 100, source boards 110*a*, 110*b*, 110*c*, and 110*d*, a gate board 130, a power control board 200, and a control board 300.

The display panel 100 includes a plurality of pixels. In an exemplary embodiment, the display device 1000 is an organic light emitting device, and each pixel may include an organic light emitting diode. The pixels may receive a data signal from a source driving circuit (D-IC), and may receive a scan signal from a gate driving circuit (GATE IC). In addition, the pixels may receive an emission control signal from an additionally provided driving circuit.

The pixels may receive a first power voltage applied to an anode of an organic light emitting diode from the power control board 200, and a second power voltage applied to a cathode of the organic light emitting diode.

The power control board 200 may be connected to the source boards 110*a*, 110*b*, 110*c*, and 110*d* through first cables CBL1. Here, the first cables CBL1 may be fastened to a first connector CNT1 of the source boards 110*a*, 110*b*, 110*c*, and 110*d*. The first cables CBL1 may include wires for providing a power voltage, a ground voltage, and a control signal. Further, the power control board 200 uses a method for fastening one of first cables CBL1 to the third connector CNT3, and it may be connected to the gate board 130.

In an exemplary embodiment, the power control board 200 may include a first voltage generator for supplying a power voltage to pixels, and it may control a driving voltage provided to driving circuits based on the voltage provided through the first cables CBL1. The power control board 200 may be a printed circuit board (PCB).

For example, the power control board 200 may generate a control signal by using the voltage transmitted through the wire for transmitting a power voltage. The power control board 200 may transmit control signals for instructing whether the first cables CBL1 are normally connected or are abnormally connected to the control board 300. When at least one of the first cables CBL1 is abnormally connected, the power control board 200 may transmit a control signal to the control board 300 so that the data signal may not be applied to the pixel so as to prevent burning caused by abnormal heating.

The control board 300 may be connected to the source boards 110*a*, 110*b*, 110*c*, and 110*d* through second cables CBL2. Here, the second cables CBL2 may be fastened to a second connector CNT2 of the source boards 110*a*, 110*b*, 110*c*, and 110*d*. The second cables CBL2 may include wires for supplying a driving voltage and control signals (source control signals, gate control signals, and clock signals). Further, the control board 300 uses a method for fastening one of second cables CBL2 to a fourth connector CNT4, and it may be directly connected to the gate board 130.

In an exemplary embodiment, the control board 300 may generate a plurality of signals for driving the display device 1000. The control board 300 may include a timing controller for controlling the driving circuits D-IC and GATE IC. The control board 300 may generate a driving voltage for driving the display device 1000. The control board 300 may be a PCB.

The source boards 110*a*, 110*b*, 110*c*, and 110*d* may be connected to the display panel 100. The source boards 110*a*, 110*b*, 110*c*, and 110*d* may be printed board assemblies (PBAs) on which modules (e.g., a driving memory) for driving the PCB are installed. In an exemplary embodiment, the source boards 110*a*, 110*b*, 110*c*, and 110*d* may be connected to the display panel 100 through driving circuit packages 120. For example, the source driving circuits (D-IC) may connect the display panel 100 and the source boards 110*a*, 110*b*, 110*c*, and 110*d* according to a chip on film (COF) or a tape carrier package (TCP).

The gate board 130 may be connected to the display panel 100. The gate board 130 may be a PBA on which modules for driving the PCB are installed. In an exemplary embodiment, the gate board 130 may be connected to the display panel 100 through driving circuit packages 140. For example, the gate driving circuits (GATE IC) may connect the display panel 100 and the gate board 130 according to the chip on film (COF) scheme or the tape carrier package (TCP) scheme.

Figure 2:
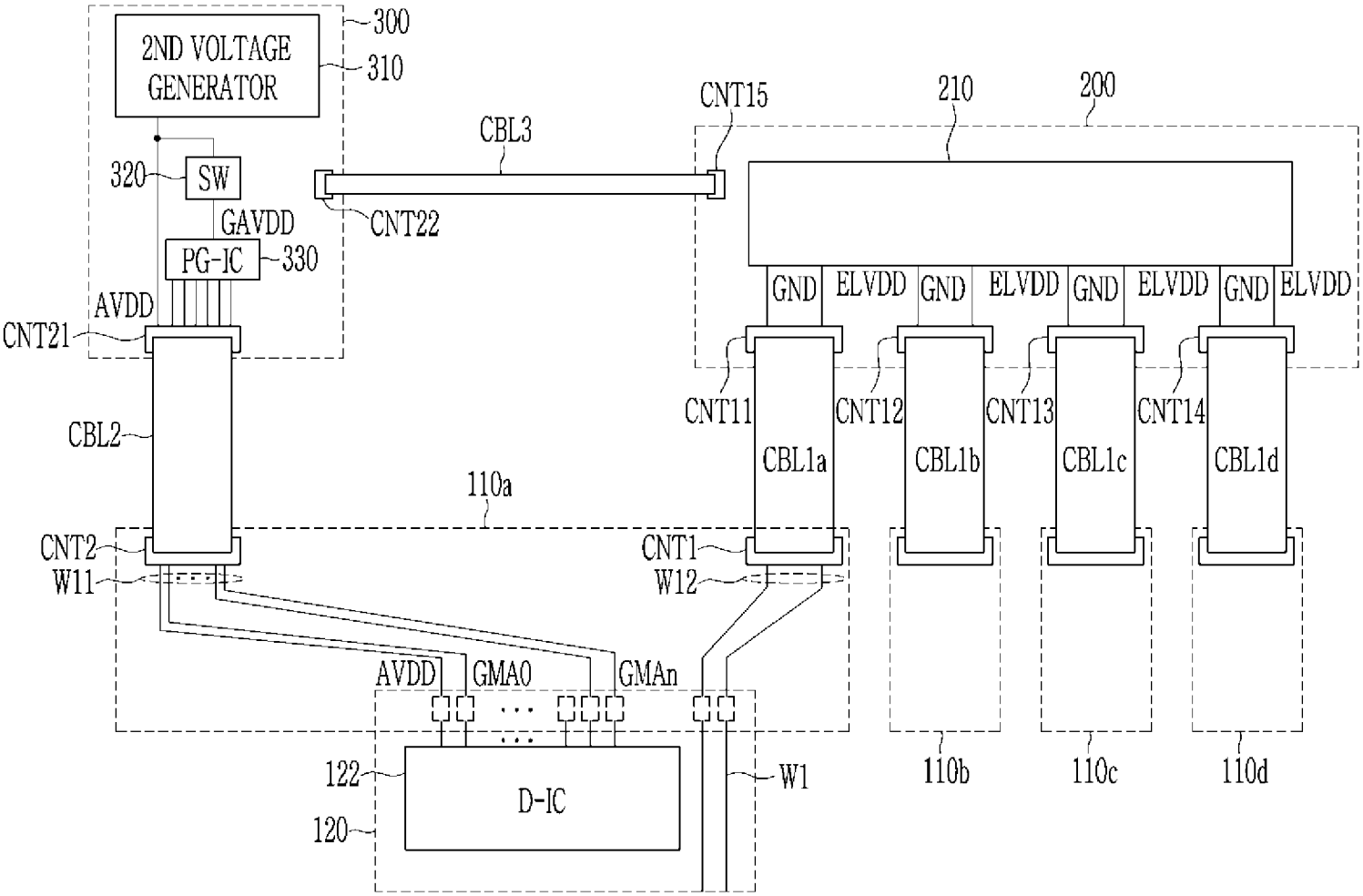
FIG. 2 shows a control board, a power control board, and a data driver of a display device shown in FIG. 1.

FIG. 2 shows a control board, a power control board, and a data driver of a display device shown in FIG. 1.

A source driving circuit 122 is installed in the driving circuit package 120, and the driving circuit package 120 is connected to the source board 110*a*. The driving circuit package 120 is connected to the source board 110*a* and is configured to receive signals and voltages.

The driving voltage AVDD and the gamma voltages GMA0 to GMAn are transmitted from the control board 300 through the second cables CBL2 fastened to the second connector CNT2 of the source board 110*a*. The driving voltage AVDD and the gamma voltages GMA0 to GMAn are transmitted to the source driving circuit 122 from the second connector CNT2 through the wires W11 of the source board 110*a*. That is, the source driving circuit 122 may receive the driving voltage AVDD and the gamma voltages GMA0 to GMAn through the source board 110*a*. The source driving circuit 122 may generate data voltages corresponding to gray data (e.g., a grayscale level) by using the gamma voltages GMA0 to GMAn. Here, the gamma voltages GMA0 to GMAn are provided by the gamma voltage generator 330 (PG-IC), and the data voltage may be a data signal corresponding to a specific pixel.

The power voltage ELVDD is transmitted from the power control board 200 through the cable CBL1*a* fastened to the first connector CNT1 of the source board 110*a*. The signal and the voltage transmitted to the first connector CNT1 are transmitted to the driving circuit package 120 through wires W12. The power voltage ELVDD may then be transmitted to the display panel 100 through the wire W1 of the driving circuit package 120.

The power control board 200 includes a first voltage generator 210, and the first voltage generator 210 is connected to the connectors CNT11, CNT12, CNT13, and CNT14. The first voltage generator 210 transmits the power voltage ELVDD to the connectors CNT11, CNT12, CNT13, and CNT14, and receives a ground voltage GND from the connectors CNT11, CNT12, CNT13, and CNT14. The respective first cables CBL1*a*, CBL1*b*, CBL1*c*, and CBL1*d* may be fastened to the corresponding connectors CNT11, CNT12, CNT13, and CNT14 of the power control board 200.

The power control board 200 may be connected to the control board 300 and may transmit and receive signals. For example, the connector CNT15 of the power control board 200 is connected to the connector CNT22 of the control board 300 through the cable CBL3. When at least one of the first cables CBL1*a*-CBLd is abnormally connected, the power control board 200 may transmit a control signal to the control board 300 so that the driving voltage AVDD may not be transmitted to the gamma voltage generator 330. Further, when the first cables CBL1 are normally connected, the power control board 200 may transmit a control signal to the control board 300 so that the driving voltage AVDD may be transmitted to the gamma voltage generator 330.

The control board 300 includes a second voltage generator 310, a switch 320, and a gamma voltage generator 330. In FIG. 2, the control board 300 is shown to include constituent elements for outputting data signals, and the control board 300 may further include constituent elements for driving gate driving circuits (GATE IC), and it is not limited thereto.

The second voltage generator 310 may generate a driving voltage AVDD and may output the same to the connector CNT21 and the gamma voltage generator 330. For example, the second voltage generator 310 may include a DC-DC converter for generating a driving voltage AVDD using an input voltage. The DC-DC converter may generate a high-potential driving voltage AVDD by boosting the input voltage. For this, the DC-DC converter may, for example, include a boosting circuit.

The switch 320 may be turned on or turned off corresponding to the control signal transmitted by the power control board 200, and it may transmit the driving voltage GAVDD to the gamma voltage generator 330.

The gamma voltage generator 330 generates input gamma voltages GMA0 to GMAn. For example, the gamma voltage generator 330 may determine reference gamma voltage levels by using the driving voltage GAVDD based on a gamma characteristic of the pixel, and may generate reference gamma voltages based on the reference gamma voltage levels. The gamma voltage generator 330 may generate gamma voltages GMA0 to GMAn by dividing reference gamma voltages. The gamma voltage generator 330 may output the gamma voltages GMA0 to GMAn to the connector CNT21.

As described above, the control board outputs the driving voltage and the gamma voltages according to the control signal output by the power control board, which will now be described in detail with reference to FIG. 3 and FIG. 4.

Figure 3:
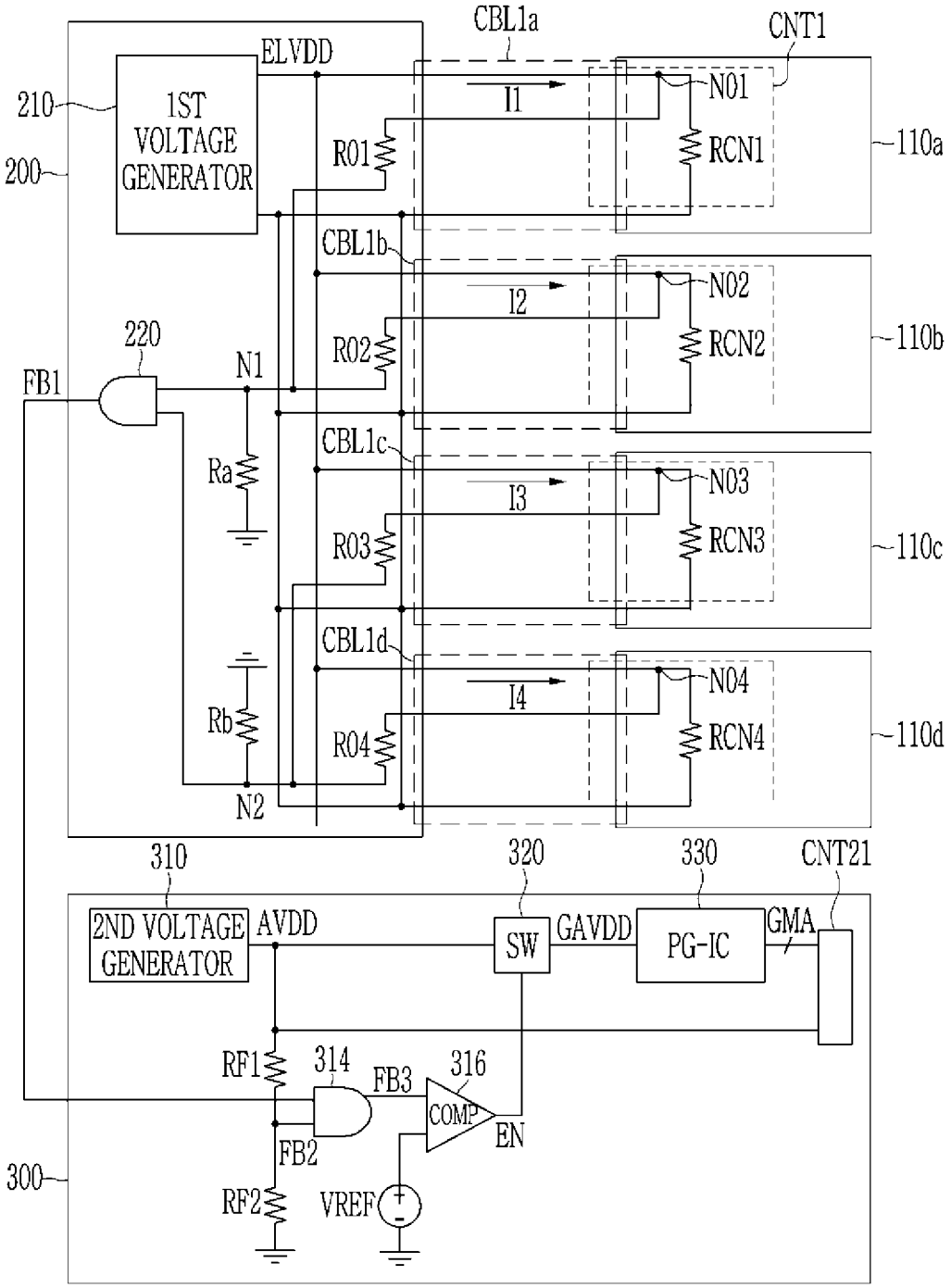
FIG. 3 shows a circuit diagram of a control board and a power control board of FIG. 2 according to an exemplary embodiment.
Figure 4:
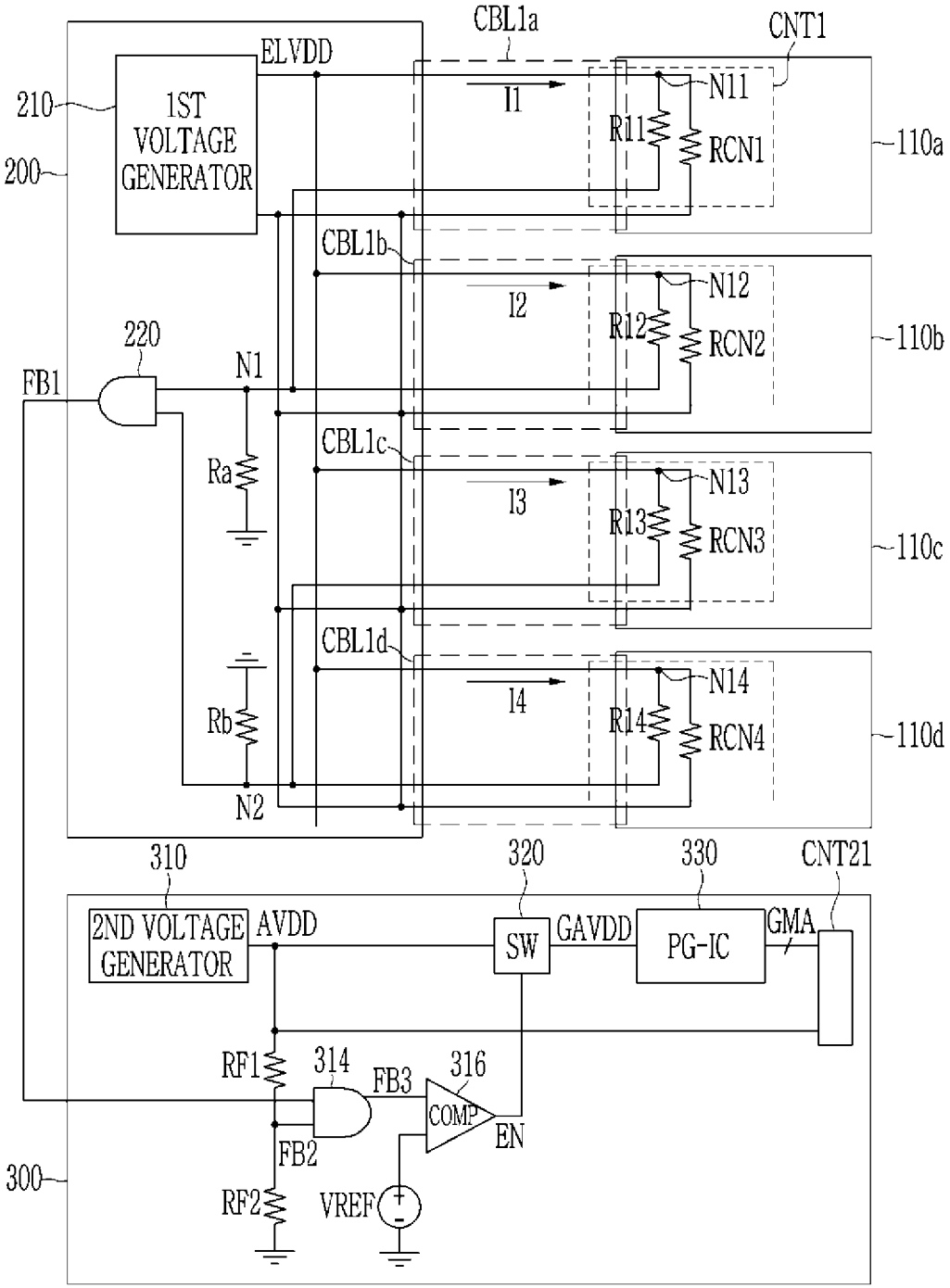
FIG. 4 shows a circuit diagram of a control board and a power control board of FIG. 2 according to another exemplary embodiment.

FIG. 3 shows a circuit diagram of a control board and a power control board of FIG. 2 according to an exemplary embodiment, and FIG. 4 shows a circuit diagram of a control board and a power control board of FIG. 2 according to another exemplary embodiment.

Referring to FIG. 3, the power control board 200 may further include sensing resistors R01 to R04, comparing resistors Ra and Rb, and a first voltage adding unit 220.

Equivalent resistors on the side of the source boards 110*a*, 110*b*, 110*c*, and 110*d* seen through the cables CBL1*a*, CBL1*b*, CBL1*c*, and CBL1*d* on the first voltage generator 210 may be shown as a resistor RCN1, a resistor RCN2, a resistor RCN3, and a resistor RCN4.

A first end of the sensing resistor R01 is connected through the cable CBL1*a* to the wire for supplying the power voltage ELVDD from the first connector CNT1 of the source board 110*a*. The sensing resistor R01 is connected to a node N01 on the side of the resistor RCN1 and the first connector CNT1. Further, a second end of the sensing resistor R01 is connected to the comparing resistor Ra at the node N1.

First ends of the sensing resistors R02, R03, and R04 are connected to the wire for supplying the power voltage ELVDD from the connector of the source boards 110*b*, 110*c*, and 110*d*. Second ends of the sensing resistor R01 and R02 are connected to the comparing resistor Ra at the node N1, and second ends of the sensing resistors R03 and R04 are connected to the comparing resistor Rb at the node N2. In this instance, it will be assumed that resistance of the sensing resistors R01 to R04 are the same and resistance of the comparing resistors Ra and Rb are the same.

When the cables CBL1*a*, CBL1*b*, CBL1*c*, and CBL1*d* are normally fastened, the voltages at the nodes N1 and N2 are the highest (case A). For example, when the cables CBL1*a*, CBL1*b*, CBL1*c*, and CBL1*d* are normally fastened, the voltage at the node N1 may be calculated according to Equation 1:

$$ELVDD \times \frac{Ra}{Ra + R01 \| R02} \quad \text{Equation 1}$$

When at least one of the cables CBL1*a*, CBL1*b*, CBL1*c*, and CBL1*d* is not normally fastened (e.g., abnormally fastened), the voltages at the nodes N1 and N2 are lower than during case A (e.g., during case B). For example, when the fastening of the cable (CBL1*a*) is abnormal, the comparing resistor (Ra) is coupled to the sensing resistor R02 in series, and the power voltage (ELVDD) is divided, so the voltage at the node N1 may be calculated according to Equation 2:

$$ELVDD \times \frac{Ra}{Ra + R02}. \quad \text{Equation 2}$$

The voltage at the node N1 and the voltage at the node N2 are input to the first voltage adding unit 220. The first voltage adding unit 220 may be configured with an analog switch, a voltage adder, an AND gate circuit, or a multiplexer, and it may be configured to output a voltage that corresponds to the sum of two voltages (e.g., the voltages at node N1 and node N2) as a control signal FB1. The power control board 200 and the control board 300 may be connected to each other through a cable (e.g., the second cables CBL2 of FIG. 2) or a wire, so the control board 300 receives a control signal FB1 from the power control board 200.

The above example has been described by assuming that there are four source boards, but the number of source boards is not limited, and a configuration of an internal circuit of the power control board 200 is modifiable according to the number of source boards. For example, when there are two source boards 110*a* and 110*b*, the voltage at the node N1 is output as a control signal FB1, and the sensing resistors R01 and R04 and the comparing resistor Rb may not be needed in the power control board 200.

The control board 300 may further include a second voltage adding unit 314 and a comparator 316. The resistors RF1 and RF2 are coupled in series to an output end of the second voltage generator 310. The voltage FB2 between the resistors RF1 and RF2 changes according to the intensity of the driving voltage AVDD transmitted to the connector CNT21. The voltage FB2 is input to the second voltage adding unit 314. Further, the control signal FB1 provided by the power control board 200 is input to the second voltage adding unit 314. The second voltage adding unit 314 may be configured with an analog switch, a voltage adder, an AND gate circuit, or a multiplexer, and the voltage that corresponds to the sum of two voltages may be output as a control signal FB3. The second voltage adding unit 314 outputs a control signal FB3 by using the control signal FB1 transmitted from the power control board 300, that is, output according to whether the first cables CBL1*a* to CBL1*d* are normally fastened, and the driving voltage AVDD transmitted to the connector CNT21 from the second voltage generator 310. The driving voltage AVDD gradually increases by voltage boosting, so the voltage value of the control signal FB2 also increases.

The comparator 316 compares the control signal FB3 and the reference voltage VREF to output an enable signal (EN) for turning on the switch 320. For example, the comparator 316 outputs an enable signal (EN) when the control signal FB3 exceeds the reference voltage VREF. That is, the comparator 316 turns on the switch 320 when a voltage level of the control signal transmitted to the control board 300 through the cable CBL3 exceeds a predetermined level and the driving voltage (VADD) reaches a predetermined level.

The comparator 316 maintains the switch 320 in the off state when a value of the control signal FB3 is equal to or less than the reference voltage VREF. For example, when the cables CBL1*a*, CBL1*b*, CBL1*c*, and CBL1*d* are abnormally fastened to the connector or the driving voltage AVDD is not boosted above a predetermined level, the comparator 316 maintains the switch 320 in the off state so that the power voltage GAVDD may not be applied to the gamma voltage generator 330.

The driving voltage GAVDD is applied to the gamma voltage generator 330 through the turned-on switch 320, and the gamma voltage generator 330 generates gamma voltages (GMA) and supplies the same to the connector CNT21.

According to an exemplary embodiment, the power voltage (GAVDD) is applied to the gamma voltage generator 330 after the power voltage (AVDD) is applied to the source driving circuit (e.g., the source driving circuit 122 of FIG. 2) by more than a predetermined level, so the source driving circuit (e.g., the source driving circuit 122 of FIG. 2) may be normally operated. Further, when the cables CBL1*a*, CBL1*b*, CBL1*c*, and CBL1*d* are abnormally fastened to the connector, the power voltage (GAVDD) is not applied to the gamma voltage generator 330, thereby preventing the display device 1000 from being burnt by the overcurrent caused by the driving of the source driving circuit (e.g., the source driving circuit 122 of FIG. 2).

Referring to FIG. 4, the constituent elements excluding the position where the sensing resistors R11 to R14 are disposed from among the constituent elements shown in FIG. 4 are the same as the constituent elements shown in FIG. 3, so they will not be described.

Equivalent resistors on the side of the source boards 110*a*, 110*b*, 110*c*, and 110*d* seen through the cables CBL1*a*, CBL1*b*, CBL1*c*, and CBL1*d* from the first voltage generator 210 may be shown as a resistor RCN1, a resistor RCN2, a resistor RCN3, and a resistor RCN4.

The sensing resistors R11, R12, R13, and R14 are formed on the source boards 110*a*, 110*b*, 110*c*, and 110*d*. The sensing resistor R11 is connected to the resistor RCN1 at the node N11 on the side of the first connector CNT1. A first end of the sensing resistor R11 is connected to the wire for supplying the power voltage (ELVDD) on the first connector CNT1 of the source board 110*a*. Further, a second end of the sensing resistor R11 is connected to the comparing resistor Ra at the node N11 of the power control board 300 through the cable CBL1*a*.

In a like manner, first ends of the sensing resistors R12, R13, and R14 are respectively connected to the wire for supplying the power voltage ELVDD on the connector of the source boards 110*b*, 110*c*, and 110*d*. A second end of the sensing resistors R11 and R12 are connected to the comparing resistor Ra at the node N1, and second ends of the sensing resistors R13 and R14 are connected to the comparing resistor Rb at the node N2. In this instance, resistance of the comparing resistors Ra and Rb are assumed to be the same.

According to an exemplary embodiment, the power voltage GAVDD is applied to the gamma voltage generator 330 after the power voltage AVDD is applied to the source driving circuit (122 of FIG. 2) by more than a predetermined level, so the source driving circuit (e.g., the source driving circuit 122 of FIG. 2) may be normally operated. Further, when the cables CBL1*a*, CBL1*b*, CBL1*c*, and CBL1*d* are abnormally fastened to the connector, the power voltage GAVDD is not applied to the gamma voltage generator 330, thereby preventing the display device 1000 from being burnt by the overcurrent caused by the driving of the source driving circuit (e.g., the source driving circuit 122 of FIG. 2).

A driving voltage controlled when a power voltage of the display device is normally applied and when it is abnormally applied will now be described with reference to FIG. 5 and FIG. 6.

Figure 5:
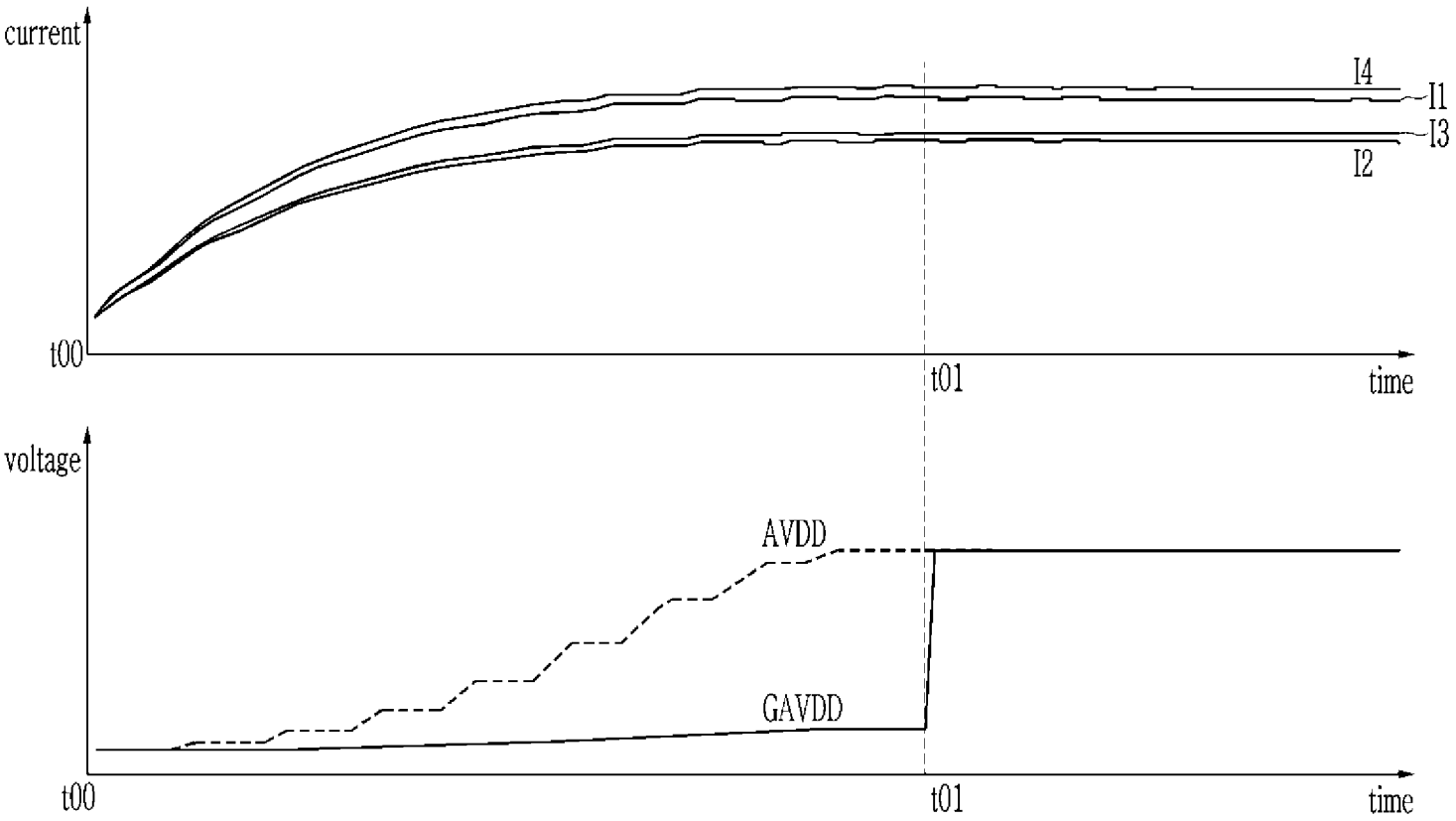
FIG. 5 shows a graph of normally applying a driving voltage when a power voltage of a display device according to an exemplary embodiment is normally applied.
Figure 6:
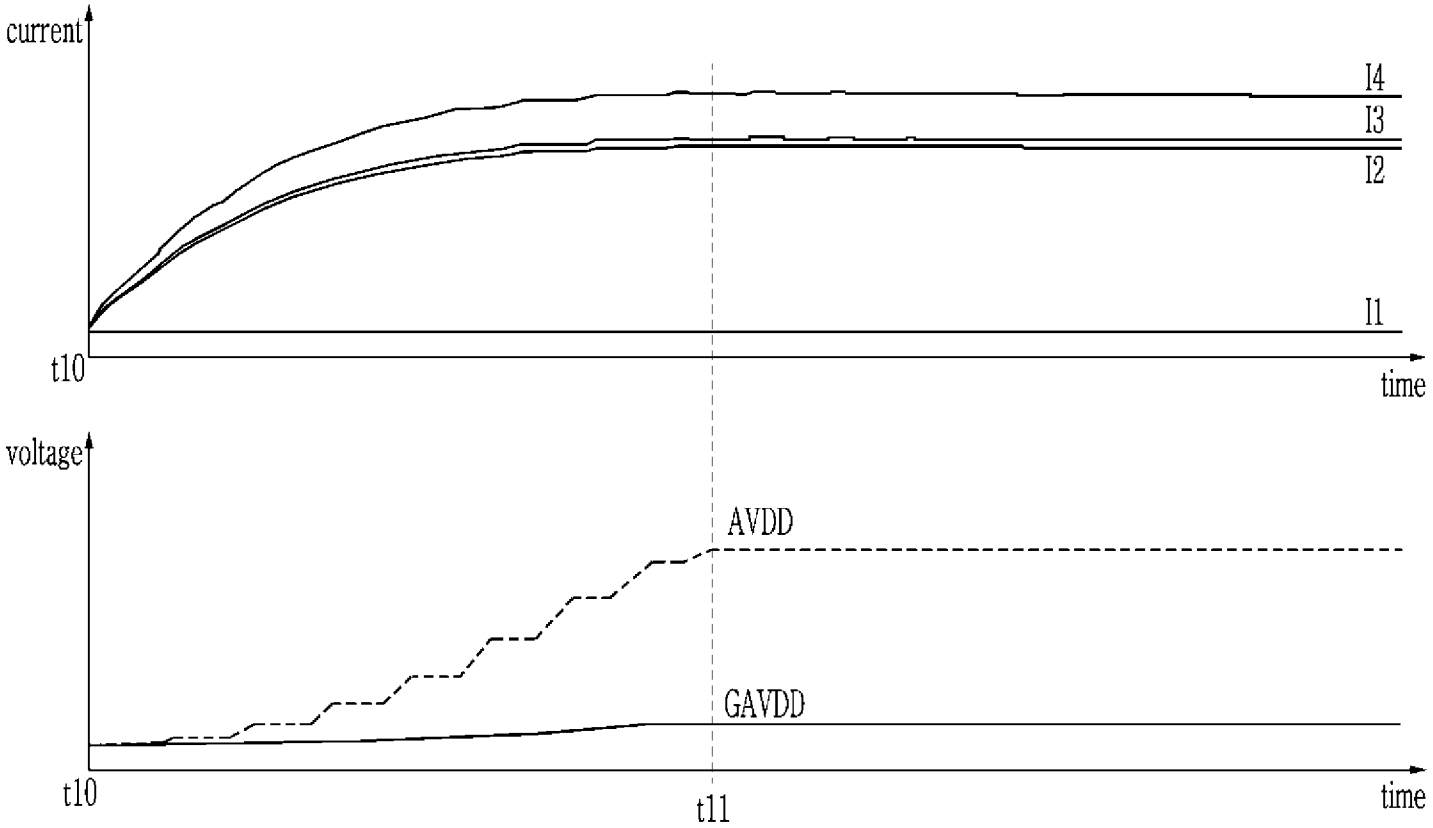
FIG. 6 shows a graph of stopping applying of a driving voltage when a power voltage of a display device according to an exemplary embodiment is abnormally applied.

FIG. 5 shows a graph of normally applying a driving voltage when a power voltage of a display device according to an exemplary embodiment is normally applied, and FIG. 6 shows a graph of stopping applying of a driving voltage when a power voltage of a display device according to an exemplary embodiment is abnormally applied.

As shown in FIG. 3 and FIG. 4, currents I1 to I4 caused by the power voltage ELVDD flow through the cables CBL1*a*, CBL1*b*, CBL1*c*, and CBL1*d*.

Referring to FIG. 5, the power voltage ELVDD begins to gradually increase at t00. Accordingly, the currents I1 to I4 flowing through the cables CBL1 a, CBL1*b*, CBL1*c*, and CBL1*d* increase.

Further, at t00, the driving voltage AVDD output by the second voltage generator 310 starts to gradually increase. Accordingly, the driving voltage AVDD supplied to the source driving circuit (e.g., the source driving circuit 122 of FIG. 2) increases.

At t01, the power voltage ELVDD reaches a predetermined level and is transmitted to the connector normally through the cables CBL1*a*, CBL1*b*, CBL1*c*, and CBL1*d*, and when the driving voltage AVDD reaches a predetermined level, the switch 320 is turned on. The driving voltage GAVDD is applied to the gamma voltage generator 330 through the turned-on switch 320. The driving voltage GAVDD may have the same level as the driving voltage AVDD.

For example, when the cables CBL1*a*, CBL1*b*, CBL1*c*, and CBL1*d* are normally fastened to the connector to which the power voltage ELVDD is normally applied, and the power voltage AVDD) that is more than a predetermined level is applied, the power voltage GAVDD is applied to the gamma voltage generator 330, so the source driving circuit (e.g., the source driving circuit 122 of FIG. 2) may be normally operated.

Referring to FIG. 6, in some cases, one of the cables may be abnormally fastened. In this example, the cable CBL1*a* is abnormally fastened.

At t10, the power voltage ELVDD gradually increases. Accordingly, the currents I2 to I4 flowing through the cables CBL1*b*, CBL1*c*, and CBL1*d* increases. However, the cable CBL1*a* is abnormally fastened, so the current I1 does not increase.

Further, at t10, the driving voltage AVDD output by the second voltage generator 310 starts to gradually increase. Hence, the driving voltage AVDD supplied to the source driving circuit (e.g., the source driving circuit 122 of FIG. 2) increases.

At t11, the power voltage ELVDD reaches a predetermined level and is normally transmitted to the connector through the cables CBL1*b*, CBL1*c*, and CBL1*d*, and when the power voltage ELVDD is not normally (e.g., abnormally) transmitted to the first connector CNT1 through the cable CBL1*a*, the switch 320 is maintained in the off state when the driving voltage AVDD reaches a predetermined level. The driving voltage GAVDD is not applied to the gamma voltage generator 330. Hence, when the cable CBL1*a* is abnormally fastened to the connector, the power voltage GAVDD is not applied to the gamma voltage generator 330, thereby preventing the display device 1000 from being burnt by the overcurrent caused by the driving of the source driving circuit (e.g., the source driving circuit 122 of FIG. 2).

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims and their equivalents.

What is claimed is:

1. A display device comprising:

a display panel comprising a plurality of pixels;

a plurality of source boards connected to the display panel, the source boards being connected to a corresponding plurality of driving circuits;

a power control board connected to the plurality of source boards and configured to supply a power voltage to the plurality of pixels; and a control board configured to control an output of gamma voltages at a plurality of gamma voltage levels supplied to the driving circuits of the source boards according to a control signal transmitted by the power control board, wherein the power control board is connected to the plurality of source boards through a plurality of first cables, wherein when at least one of the plurality of first cables is abnormally connected to at least one of the plurality of source boards, the power control board generates a driving voltage of the driving circuits of the source boards and outputs the control signal to prevent the output of gamma voltages to the at least one of the plurality of source boards, wherein the control board is connected to the plurality of source boards through a plurality of second cables, and wherein the control board is configured to supply the gamma voltages to the plurality of source boards through the plurality of second cables.

2. The display device of claim 1, wherein the power control board is configured to output the control signal by using values of the power voltage applied to the plurality of pixels.

3. The display device of claim 1, wherein the power control board comprises a plurality of first connectors, the plurality of source boards respectively each comprise a second connector, and first ends of the plurality of first cables are connected to the first connectors, and second ends of the plurality of first cables are connected to each second connector of respective source boards.

4. The display device of claim 3, wherein the plurality of first cables respectively comprise a power voltage wire, the power control board comprises a sensing resistor of which a first end is connected to the power voltage wire when the plurality of first cables are normally fastened to the second connector, and the first end is not connected to the power voltage wire when the plurality of first cables are abnormally fastened to the second connector, and a comparing resistor connected to a second end of the sensing resistor, and the control signal corresponds to a voltage value divided by the sensing resistor and the comparing resistor.

5. The display device of claim 4, wherein the voltage value divided by the sensing resistor and the comparing resistor is higher when the plurality of first cables are normally fastened to the second connector than when the plurality of first cables are abnormally fastened to the second connector.

6. The display device of claim 3, wherein the first cables respectively comprise a power voltage wire, the plurality of source boards respectively comprise a sensing resistor of which a first end is connected to the power voltage wire when the first cables respectively are normally fastened to the second connector, and the first end is not connected to the power voltage wire when the first cables are respectively abnormally fastened to the second connector, the power control board comprises a comparing resistor connected to a second end of the sensing resistor when the first cables are normally fastened to the second connector, and not connected to the second end of the sensing resistor when the first cables are abnormally fastened to the second connector, and the control signal corresponds to a voltage value divided by the sensing resistor and the comparing resistor.

7. The display device of claim 1, wherein the control board comprises:

a voltage generator to generate a driving voltage of a driving circuit for generating a data signal applied to at least one of the plurality of pixels;

a gamma voltage generator to receive the driving voltage and to generate a plurality of gamma voltages applied to the driving circuit; and a switch to transmit the driving voltage to the gamma voltage generator corresponding to the control signal.

8. The display device of claim 7, wherein the driving voltage and the plurality of gamma voltages are transmitted to the plurality of source boards through the plurality of second cables.

9. The display device of claim 8, wherein the switch is configured to transmit the driving voltage to the gamma voltage generator according to an intensity of the driving voltage and the control signal transmitted to the second cables.

10. The display device of claim 7, wherein the driving circuit is mounted on a driving circuit package to connect the display panel and the plurality of source boards.

11. The display device of claim 10, wherein the power voltage is transmitted to the plurality of pixels through a wire of the driving circuit package.

12. The display device of claim 1, wherein the control board and the power control board are connected through a third cable, and when the control signal transmitted to the control board through the third cable exceeds a predetermined level, voltages supplied to the source boards are output.

13. A display device comprising:

a display panel comprising a plurality of pixels;

a plurality of source boards connected to the display panel, the source boards being connected to a corresponding plurality of driving circuits;

a power control board configured to transmit a power voltage to the plurality of pixels through a plurality of cables, and to output a voltage corresponding to a voltage value transmitted through the plurality of cables as a control signal; and a control board configured to generate a plurality of gamma voltages applied to a driving circuit of the driving circuits when a driving voltage for operating the driving circuit and a voltage corresponding to a sum of the driving voltage and the control signal exceeds a predetermined level, wherein the driving circuit is configured to generate a data signal to be transmitted to the plurality of pixels, wherein the power control board is connected to the plurality of source boards through a plurality of first cables, wherein when at least one of the plurality of first cables is abnormally connected to at least one of the plurality of source boards, the power control board generates a driving voltage of the driving circuits of the source boards and outputs the control signal to prevent the output of gamma voltages to the at least one of the plurality of source boards, wherein the control board is connected to the plurality of source boards through a plurality of second cables, and wherein the control board is configured to supply the gamma voltages to the plurality of source boards through the plurality of second cables.

14. The display device of claim 13, wherein a voltage value of the control signal changes according to a fastening state of the plurality of cables.

15. The display device of claim 14, wherein the power control board comprises an AND gate circuit for generating the control signal by performing an AND operation on the voltage corresponding to the voltage value transmitted through the plurality of cables.

16. The display device of claim 13, wherein the control board comprises:

a gamma voltage generator configured to generate the gamma voltages;

a switch configured to transmit the driving voltage to the gamma voltage generator; and an AND gate circuit configured to output a signal for controlling the switch by performing an AND operation on the driving voltage and a voltage of the control signal.

17. A display device comprising:

a display panel comprises a plurality of pixels;

a plurality of source boards connected to the display panel;

a plurality of driving circuit packages, each comprising a driving circuit configured to connect the display panel and a corresponding source board and to generate a data signal applied to the plurality of pixels, and to transmit a power voltage to the pixels;

a power control board connected to the plurality of source boards through a plurality of first cables and configured to transmit the power voltage; and a control board connected to the source boards through the plurality of first cables, wherein the control board is configured to generate a driving voltage for operating the driving circuit and a plurality of gamma voltages, to transmit the driving voltage and the plurality of gamma voltages to the source boards in accordance with a control signal transmitted by the power control board, and to control the gamma voltages corresponding to levels of the power voltage and the driving voltage, wherein the power control board is connected to the plurality of source boards through a plurality of first cables, wherein when at least one of the plurality of first cables is abnormally connected to at least one of the plurality of source boards, the power control board generates a driving voltage of the driving circuits of the source boards and outputs the control signal to prevent the output of gamma voltages to the at least one of the plurality of source boards, wherein the control board is connected to the plurality of source boards through a plurality of second cables, and wherein the control board is configured to supply the gamma voltages to the plurality of source boards through the plurality of second cables.

* * * * *